US009719750B2

(12) United States Patent
Gouramanis

(10) Patent No.: US 9,719,750 B2
(45) Date of Patent: Aug. 1, 2017

(54) UNIVERSAL ARCHERY BOW PRESS

(71) Applicant: Georgios Gouramanis, Lindenhurst, NY (US)

(72) Inventor: Georgios Gouramanis, Lindenhurst, NY (US)

( * ) Notice: Subject to any disclaimer, the term of this patent is extended or adjusted under 35 U.S.C. 154(b) by 0 days.

(21) Appl. No.: 15/175,165

(22) Filed: Jun. 7, 2016

(65) Prior Publication Data

US 2016/0282078 A1 Sep. 29, 2016

Related U.S. Application Data

(63) Continuation of application No. 14/340,086, filed on Jul. 24, 2014, now Pat. No. 9,366,498, which is a continuation of application No. 13/109,325, filed on May 17, 2011, now Pat. No. 8,789,518.

(51) Int. Cl.
*F41B 5/14* (2006.01)
*F41B 5/10* (2006.01)

(52) U.S. Cl.
CPC ..... *F41B 5/1449* (2013.01); *F41B 5/10* (2013.01); *F41B 5/14* (2013.01); *F41B 5/1403* (2013.01)

(58) Field of Classification Search
CPC ..... F41B 5/1449
USPC ..... 124/1, 86
See application file for complete search history.

(56) References Cited

U.S. PATENT DOCUMENTS 3,055,655 A * 9/1962 Chelf ..... F41B 5/1449 124/23.1
4,331,311 A * 5/1982 Russell ..... F16M 13/00 124/23.1
4,360,179 A * 11/1982 Roberts ..... F41B 5/14 124/23.1
5,022,377 A * 6/1991 Stevens ..... F41B 5/1449 124/23.1
5,048,504 A * 9/1991 Ballard ..... F41B 5/14 124/23.1
5,222,473 A * 6/1993 Lint ..... F41B 5/1449 124/1
5,344,110 A * 9/1994 Scarpa ..... F41B 5/14 124/86
5,370,103 A * 12/1994 Desselle ..... F41B 5/1449 124/23.1
5,433,186 A * 7/1995 Corwin ..... F41B 5/1449 124/1
5,791,610 A * 8/1998 Sanchez ..... F41B 5/14 224/916

(Continued)

OTHER PUBLICATIONS

Cabela's World's Foremost Outfitter Archery, p. 52, (2011).

*Primary Examiner* — Alexander Niconovich
(74) *Attorney, Agent, or Firm* — Carter, DeLuca, Farrell & Schmidt, LLP

(57) ABSTRACT

An archery bow press is disclosed including a frame having at least two arm members and being actuatable to move the at least two arm members relative to one another. The frame also includes at least one elongate member having a first end portion adapted for insertion into an opening of one of the at least two arm members and at least one gripper defining an opening therein for the reception of a second end portion of the at least one elongate member. The gripper is adapted to at least partially surround an archery bow limb and removably attach to the archery bow limb.

24 Claims, 15 Drawing Sheets

(56) References Cited

U.S. PATENT DOCUMENTS 5,983,879 A * 11/1999 Gifford ..... F41B 5/1449 124/1
6,220,235 B1 * 4/2001 Sands ..... F41B 5/1449 124/1
6,386,190 B1 * 5/2002 Kurtz, Jr. ..... F41B 5/1449 124/1
6,520,170 B1 * 2/2003 Adkins ..... F41G 1/467 124/44.5
6,520,171 B2 * 2/2003 Reible ..... F41B 11/52 124/73
6,679,465 B1 * 1/2004 Leasure ..... F41B 5/14 124/23.1
6,932,070 B1 * 8/2005 Kurtz, Jr. ..... F41B 5/1449 124/1
6,968,834 B1 * 11/2005 Gibbs ..... F41B 5/1449 124/1
7,185,644 B2 * 3/2007 Kurtz, Jr. ..... F41B 5/14 124/1
7,255,099 B2 * 8/2007 Henry ..... F41B 5/1449 124/1
7,311,095 B2 * 12/2007 Bauder ..... F41B 5/14 124/1
7,597,094 B2 * 10/2009 Pittman ..... F41B 5/14 124/1
7,614,592 B2 * 11/2009 Bean ..... F41A 23/18 248/126
7,644,708 B2 * 1/2010 Pittman ..... F41B 5/14 124/1
8,096,059 B2 * 1/2012 Stagg ..... F41B 5/14 124/1
8,141,546 B2 * 3/2012 Liu ..... F41B 5/1449 124/1
8,297,605 B2 * 10/2012 Lee ..... F16C 11/106 269/130
8,387,600 B1 * 3/2013 Horn ..... F41B 5/1449 124/1
8,402,955 B2 * 3/2013 Tulpa ..... F41B 5/14 124/1
8,505,523 B1 * 8/2013 Horn ..... F41B 5/1449 124/1
8,505,526 B1 * 8/2013 McPherson ..... F41B 5/10 124/23.1
8,789,518 B2 7/2014 Gouramanis
8,851,057 B2 * 10/2014 Pulkrabek ..... F41B 5/1449 124/1
8,882,070 B2 11/2014 Bean et al.
9,255,760 B2 * 2/2016 Tulpa ..... F41B 5/1449
9,366,498 B2 6/2016 Gouramanis
9,389,040 B2 * 7/2016 McPherson ..... F41B 5/10
2006/0000462 A1 * 1/2006 Kurtz, Jr. ..... F41B 5/14 124/1
2006/0191522 A1 * 8/2006 Henry ..... F41B 5/1449 124/23.1
2007/0119438 A1 * 5/2007 Pittman ..... F41B 5/14 124/1
2009/0056688 A1 * 3/2009 Marsh ..... F41B 5/14 124/1
2009/0071022 A1 * 3/2009 Stagg ..... F41B 5/14 33/265
2009/0107475 A1 * 4/2009 Pittman ..... F41B 5/14 124/86
2010/0089376 A1 * 4/2010 Bunk ..... F41B 5/14 124/86
2011/0162631 A1 * 7/2011 Tulpa ..... F41B 5/14 124/86
2014/0060513 A1 * 3/2014 Tulpa ..... F41B 5/14 124/86
2017/0067713 A1 * 3/2017 McKinney ..... F41B 5/1449

* cited by examiner

UNIVERSAL ARCHERY BOW PRESS

CROSS-REFERENCE TO RELATED APPLICATIONS

This application is a continuation of U.S. patent application Ser. No. 14/340,086 by G. Gouramanis, filed on Jul. 24, 2014, now U.S. Pat. No. 9,366,498, which is a continuation of U.S. patent application Ser. No. 13/109,325, by G. Gouramanis, filed on May 17, 2011, now U.S. Pat. No. 8,789,518 entitled "UNIVERSAL ARCHERY BOW PRESS", the entire contents of each of the foregoing incorporated by reference herein.

BACKGROUND

Technical Field

The present invention relates generally to archery bow presses for the maintenance of archery bows, and more particularly, to an archery bow press for the maintenance of various types of bows of varying size.

Description of Related Art

Archery bow presses are used in the maintenance of archery bows, and in particular, are necessary for the maintenance of compound bows, where force is required to compress the bow in order to remove the bow string(s) and perform other repair and maintenance operations.

Typical bow presses contract a bow by applying a force to the ends of the bow limbs or by applying force to the handle of the bow to force the bow limbs against a set of rollers. Some bows, and compound bows in particular, have split limbs or split limb ends and various features located at the limb ends that can interfere with the press at the point of force application. This makes it difficult to uniformly apply a force to the split limbs or split limb ends of the bow in such a way that the bow does not twist in the press or become damaged due to concentration of force at one point. The limb end features however are not uniform among the bows, and may include idler wheels, cams and other structural differences. These differences can vary from model to model and also among bows of different manufacturers. Some bow presses which contract a bow by applying force to the split limb ends can be seen in U.S. Pat. Nos. 7,597,094 and 7,644,708 to Pittman.

However, applying force to split limbs or split limb ends may be problematic in that as force is applied to the limbs or limb ends, the limb ends tend to ride up on the bow press and may potentially break free of the bow press under load, thereby damaging the bow and potentially injuring the operator. In addition the force being applied to the split limbs or split limb ends is often a frictional force which may fail to properly secure the bow in place. This is especially the case for bows with a larger curvature since as force is applied to the limb ends, the limb ends become substantially vertically oriented, thereby increasing the risk that the bow will break free.

SUMMARY

One aspect of the disclosure is to provide a new and improved universal archery bow press which can compress various types and sizes of bows in an easy and efficient manner and which maintains control of the bow during a maintenance operation. The presently disclosed archery bow press utilizes a gripping assembly for securing the archery bow prior to applying force to the bow limbs.

An archery bow press is disclosed including a frame having at least two arm members and being actuatable to move the at least two arm members relative to one another. The frame also includes at least one elongate member having a first end portion adapted for insertion into an opening of one of the at least two arm members and at least one gripper defining an opening therein for the reception of a second end portion of the at least one elongate member. The gripper is adapted to at least partially surround an archery bow limb and removably attach to the archery bow limb.

Each arm member may include a passage extending at least partially therethrough for the reception of a bracket where the bracket includes at least one opening and the opening of the arm member is one of the openings of the bracket. A first of the openings of the bracket may define a first longitudinal axis and a second of the opening may define a second longitudinal axis disposed at an angle relative to the first longitudinal axis where the elongate member may be insertable into either of the first and second openings. The passage of each arm member may alternatively receive two brackets. Each bracket may include a screw hole extending therethrough for the reception of a mounting screw where the screw hole defines a smooth inner bore to allow the bracket to rotate about the screw hole when the mounting screw is inserted therethrough. Each bracket may also include an inwardly depending section adapted to allow the bracket to at least partially rotate about the screw hole when inserted into the passage of one of the arm members.

The arm members may be configured to space an archery bow away from the frame and may be oriented at a forty-five degree angle relative to a longitudinal axis of a leg of the frame. The frame may include an inner shaft and an outer shaft movable relative to the inner shaft upon actuation of an actuating mechanism where each arm member extends from one of the inner and outer shafts. The inner and outer shafts may also define a diamond shaped cross-section.

The elongate member may define a rounded tip at the second end portion and a tapered portion extending from the rounded tip toward the first end portion. The rounded tip is adapted to allow the gripper assembly to rotate about the second end portion of the elongate member when the elongate member is inserted into gripper assembly.

A gripper assembly for use with an archery bow press is also disclosed including a gripper having a first portion and a second portion. The second portion defines an opening therein for the reception of a member of the archery bow press and the first and second portions define a space therebetween for the at least partial reception of an archery bow limb.

The gripper may also include at least one pad where the at least one pad is adapted to press against an archery bow limb to secure the archery bow limb to the gripper. A first of the at least one pads may be moveable between the first and second portions of the gripper by a pad screw inserted through an opening extending through the first portion of the gripper. A second of the at least one pads may fixedly attached to the second portion. The second portion of the gripper may also include at least one safety screw hole therethrough for the reception of a safety screw. The gripper may also form a "C" shape.

A mounting assembly for use with an archery bow press is also disclosed. The mounting assembly includes a bracket having at least one opening extending at least partially therethrough and being adapted for insertion into a passage of the archery bow press, a elongate member insertable into one of the at least one openings of the bracket and a gripper assembly mountable onto the elongate member.

A first of the at least one openings defines a first longitudinal axis and a second of the at least one openings defines a second longitudinal axis disposed an angle relative to the first longitudinal axis where the elongate member is insertable into one of the first and second of the at least one openings. The elongate member includes a first end portion and a second end portion and the first end portion may be adapted for insertion into one of the at least one openings while the second end portion may be adapted for insertion into an opening of the gripper assembly. The second end portion may also include a rounded tip adapted to allow the gripper assembly to rotate about the second end portion of the elongate member.

The gripper assembly may also include at least one safety screw hole for the reception of a safety screw therethrough where the safety screw is adapted to secure the gripper assembly to a second gripper assembly of a second mounting assembly upon insertion through the safety screw hole and a respective safety screw hole of the second gripper assembly.

The passage of the archery bow press may be disposed in a mounting member where the mounting member is removably attachable to the archery bow press adapted for securing the bracket within the passage.

BRIEF DESCRIPTION OF THE DRAWINGS

The accompanying drawings, which are incorporated in and constitute a part of this specification, illustrate embodiments of the presently disclosed universal archery bow press, and together with a general description of the presently disclosed universal archery bow press given above, and the detailed description of the embodiments given below, serve to explain the principles of the presently disclosed universal archery bow press.

DETAILED DESCRIPTION

Disclosed herein is a universal archery bow press which provides for an easy and intuitive way of compressing a bow for maintenance. As used herein, the term "bow" includes any type of bow currently in use, including, for example, longbows, recurve bows, compound bows, etc. The term "gripper" as used herein includes any gripping or support mechanism including but not limited to clamps, clasps, clips, friction fittings, friction pads, or other mechanisms for securing or mounting an archery bow limb. The term "wheel" or "cam" as used herein includes any mechanism for use with a compound bow which can be adjusted to change the draw length and draw weight of the bow such as, for example, pullies, gears, etc and is not to be limited to only wheels and cams.

Figure 12:
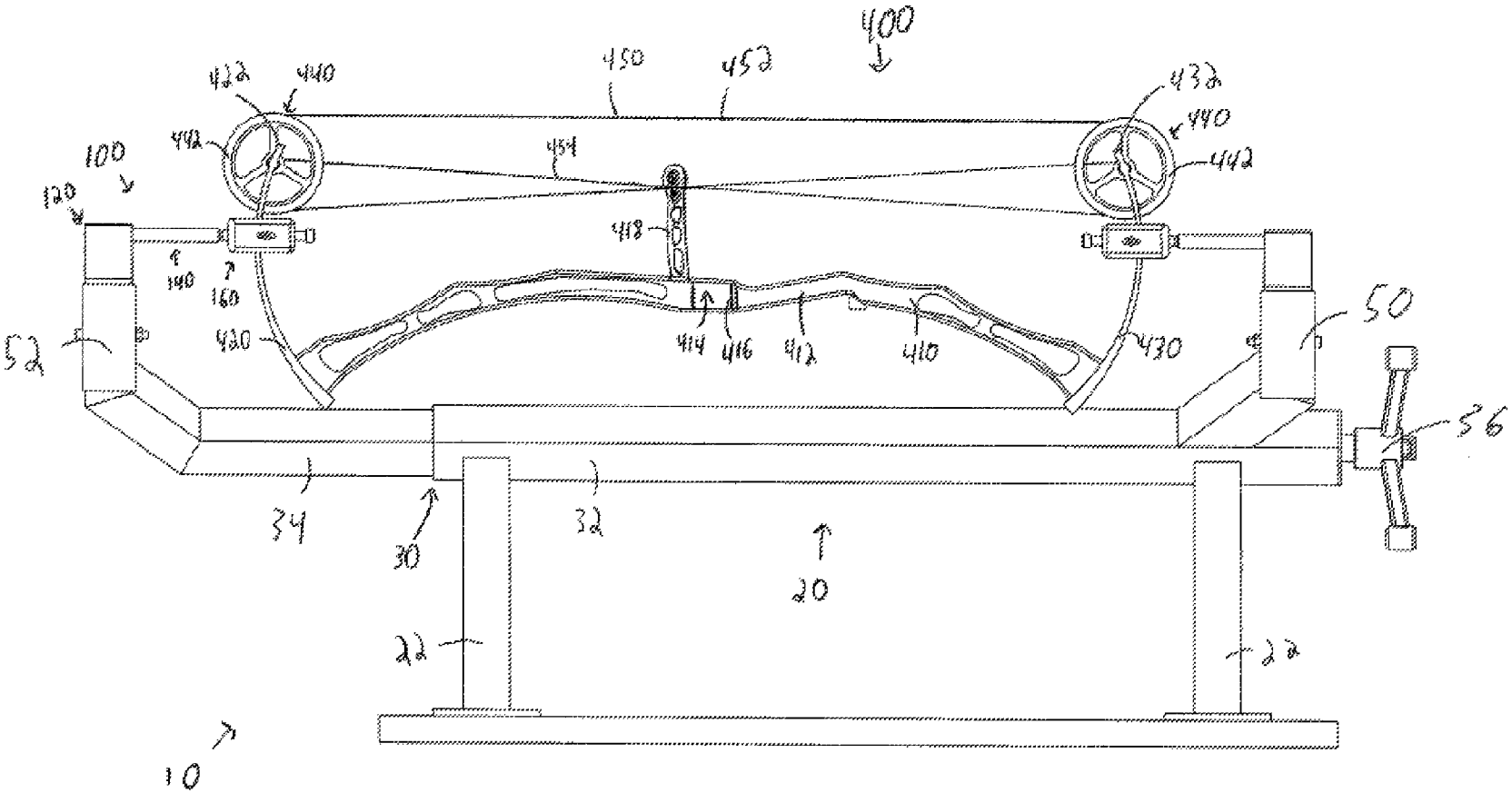
FIG. 12 is a side view of the archery bow press of FIG. 1 with an archery bow mounted to the archery bow press in an uncompressed state.
Figure 13:
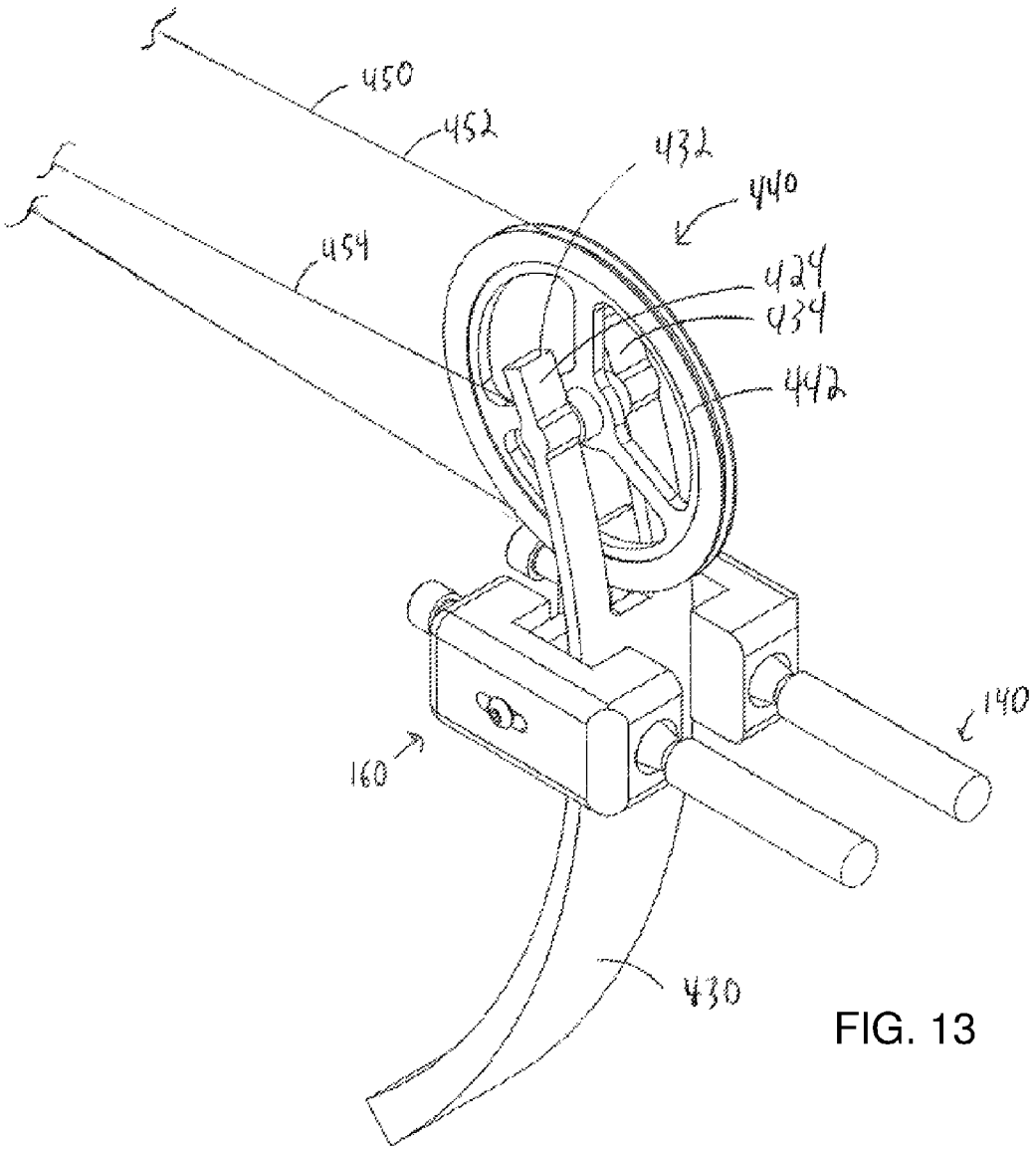
FIG. 13 is a perspective view of the gripper of the archery bow press of FIG. 12 showing the gripper securing the archery bow in place.
Figure 14:
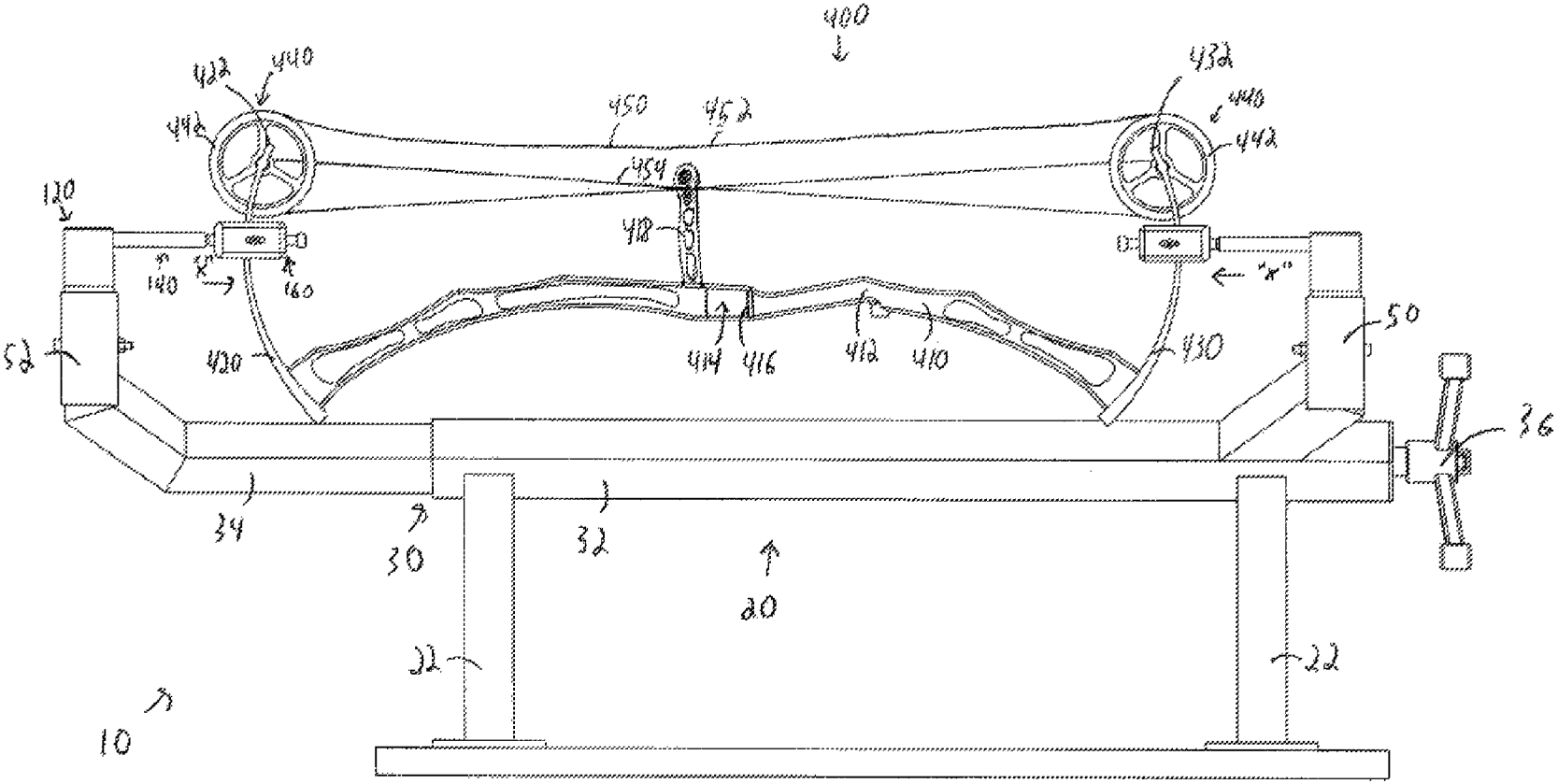
FIG. 14 is a side view of the archery bow press of FIG. 12 with the archery bow in a compressed state.

With reference to FIGS. 12-14, an archery bow 400 is shown including a handle or riser 410 having an upper limb 420, and a lower limb 430 extending therefrom. Depending on the type of bow 400, handle/riser 410 may only include a grip 412 or may include additional features such as a sight window 414, an arrow rest 416, a cable guard 418 (in the case of a compound bow), a bowsight (not shown), or other features known in the art. Upper limb 420 includes an upper end 422 and lower limb 430 includes a lower end 432. Upper and lower ends 422 and 432 include a string or cable retaining mechanism 440 for attaching a string/cable 450 to bow 400 and may include string grooves (not shown) for retaining string/cable 450 or in the case of a compound bow 400, split limbs 424, 434 for retaining wheels/cams 442. Split limbs 424 and 434 may be disposed near upper and lower ends 422 and 432 only or may instead extend along a portion of each of the upper and lower bow limbs 420 and 430. Split limbs 424 and 434 may also extend the entire length of bow limbs 420 and 430. In a compound bow 400, string/cable 450 is wound around wheels/cams 442 of each end 422, 432 where typically string/cable 450 includes both a string portion 452 and a cable portion 454. Wheels and cams 442 may be interchangeable depending on the needs of the user.

Figure 1:
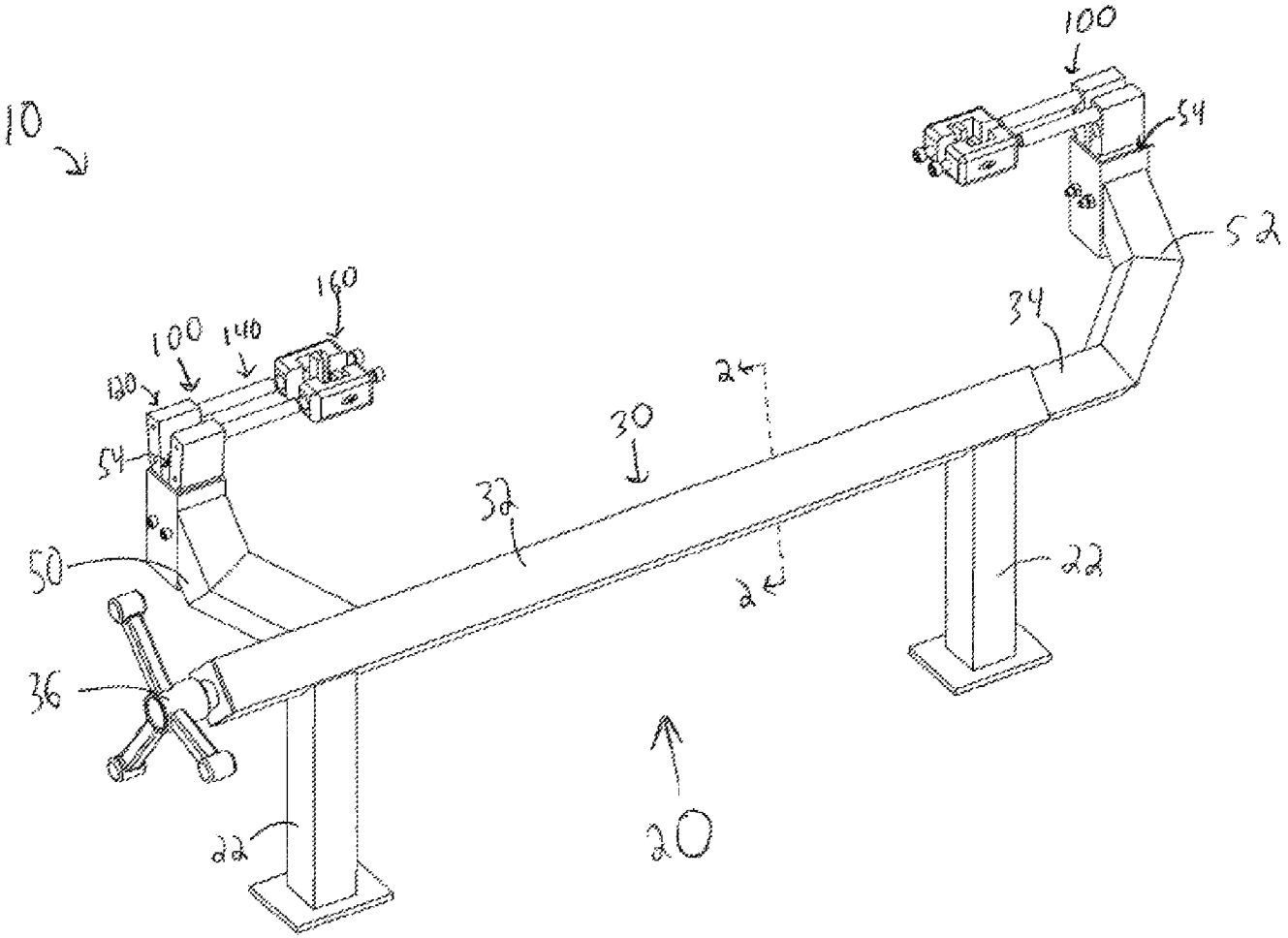
FIG. 1 is a perspective view of an archery bow press in accordance with the present disclosure.
Figure 2:
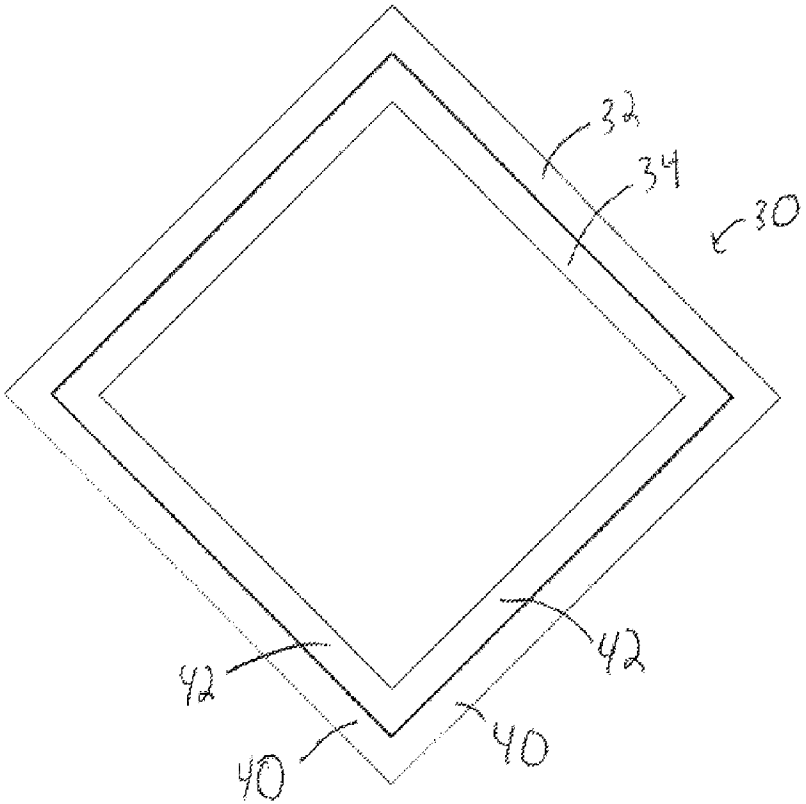
FIG. 2 is a cross-sectional view of the telescoping section of the archery bow press of FIG. 1 taken along section line 2-2.
Figure 3:
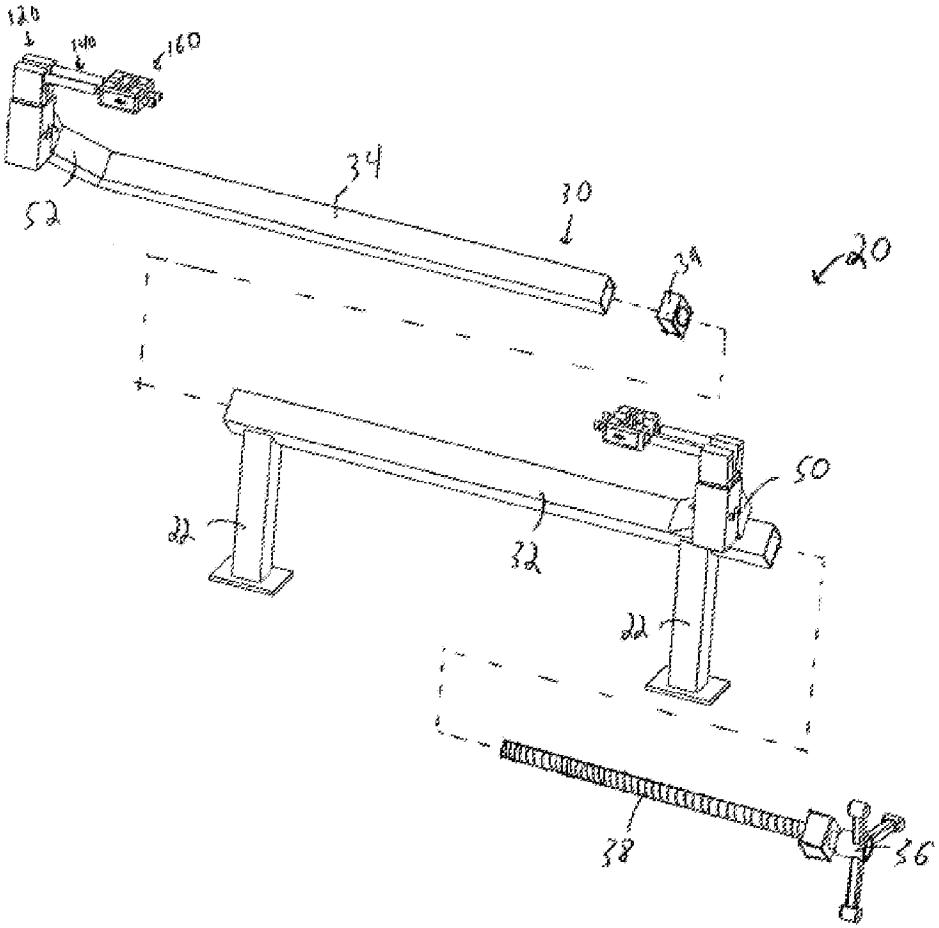
FIG. 3 is a exploded perspective view of the archery bow press of FIG. 1.

With reference to FIGS. 1-3 an archery bow press 10 is disclosed. Bow press 10 includes a frame 20, and at least one mounting assembly 100. Frame 20 includes a pair of legs 22 for mounting to a base or workbench. There may alternatively be a single leg 22, or more than two legs 22. Frame 20 also includes a telescoping section 30 disposed on legs 22 and defining a diamond shaped cross-section.

Telescoping section 30 includes an outer shaft 32 and an inner shaft 34 inserted into outer shaft 32 and movable relative to outer shaft 32 in an axial direction upon actuation of an actuating member 36. Outer shaft 32 is disposed on legs 22 while inner shaft 34 is left free to slide relative to outer shaft 32. Actuating member 36 is mechanically coupled to inner shaft 34 via a worm gear 38 mounted to outer shaft 32 and a gear block 39 mounted to inner shaft 34 and defining a internal thread (not shown) for the reception of worm gear 38. Actuation of actuating member 36 rotates worm gear 38 through gear block 39 (FIG. 3) to extend or retract inner shaft 34 relative to outer shaft 32. Actuating member 36 may be mechanical, such as a handle or wheel, or may be any other actuating device as known in the art including, for example, an electric motor or a hydraulic mechanism. Worm gear 38 may be any other type of gear or mechanism which can impart axial motion to an object and apply a load to that object in an axial direction, as known in the art. The diamond shaped cross section of telescoping section 30 allows for improved sliding of inner shaft 34 relative to outer shaft 32 due to respective angled sides 40 and 42 (FIG. 2) where angled sides 42 of inner shaft 34 seat into angled sides 40 outer shaft 32. Other cross-sectional shapes may also be used such as, for example, a triangle, a circle, square, or any other polygonal shape, as known in the art.

Frame 20 also includes arm members 50 and 52 extending from outer and inner shafts 32 and 34 respectively. Arm members 50 and 52 extend at a forty-five degree angle to the longitudinal axis each of legs 22, respectively and each arm member 50 and 52 includes a passage 54 therethrough for the reception of a mounting assembly 100. Arm members 50 and 52 may alternatively extend at angles other than forty-five degrees to the longitudinal axis of legs 22 as desired and necessary for bows of various shapes and sizes. Arm members 50 and 52 are configured to space bow 400 away from frame 20 during use to allow for ease of access to bow 400 by an operator.

Figure 4:
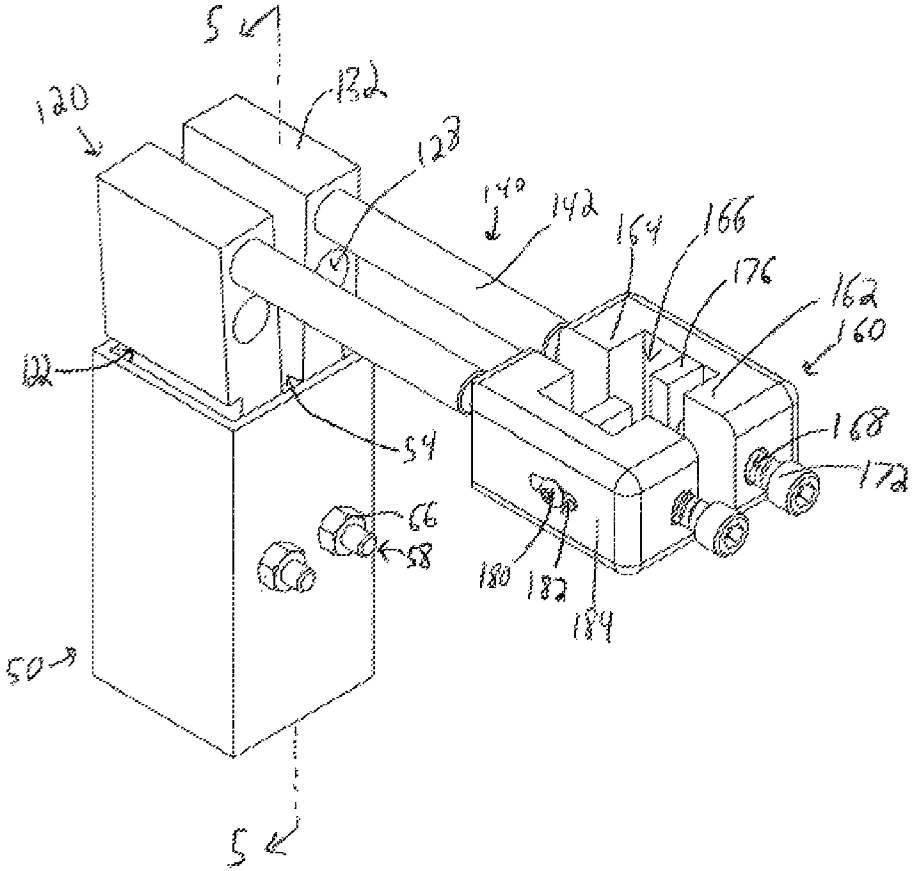
FIG. 4 is a perspective view of the mounting assembly of the archery bow press of FIG. 1.

With reference to FIGS. 4-5, each arm member 50 and 52 also includes a plurality of holes 56 extending through the wall of passage 54 for the reception of screws 58 therethrough. Screws 58 secure mounting assembly 100 to arm members 50 and 52 within passage 54 while still allowing for rotation of mounting assembly 100 about screws 58. Each screw 58 includes a screw head 60 a smooth body 62 and a threaded end 64. When inserted through holes 56, screw head 60 abuts a side of passage 54 and threaded end 64 extends out of an opposite side of passage 54 for fastening by a nut 66.

Figure 5A:
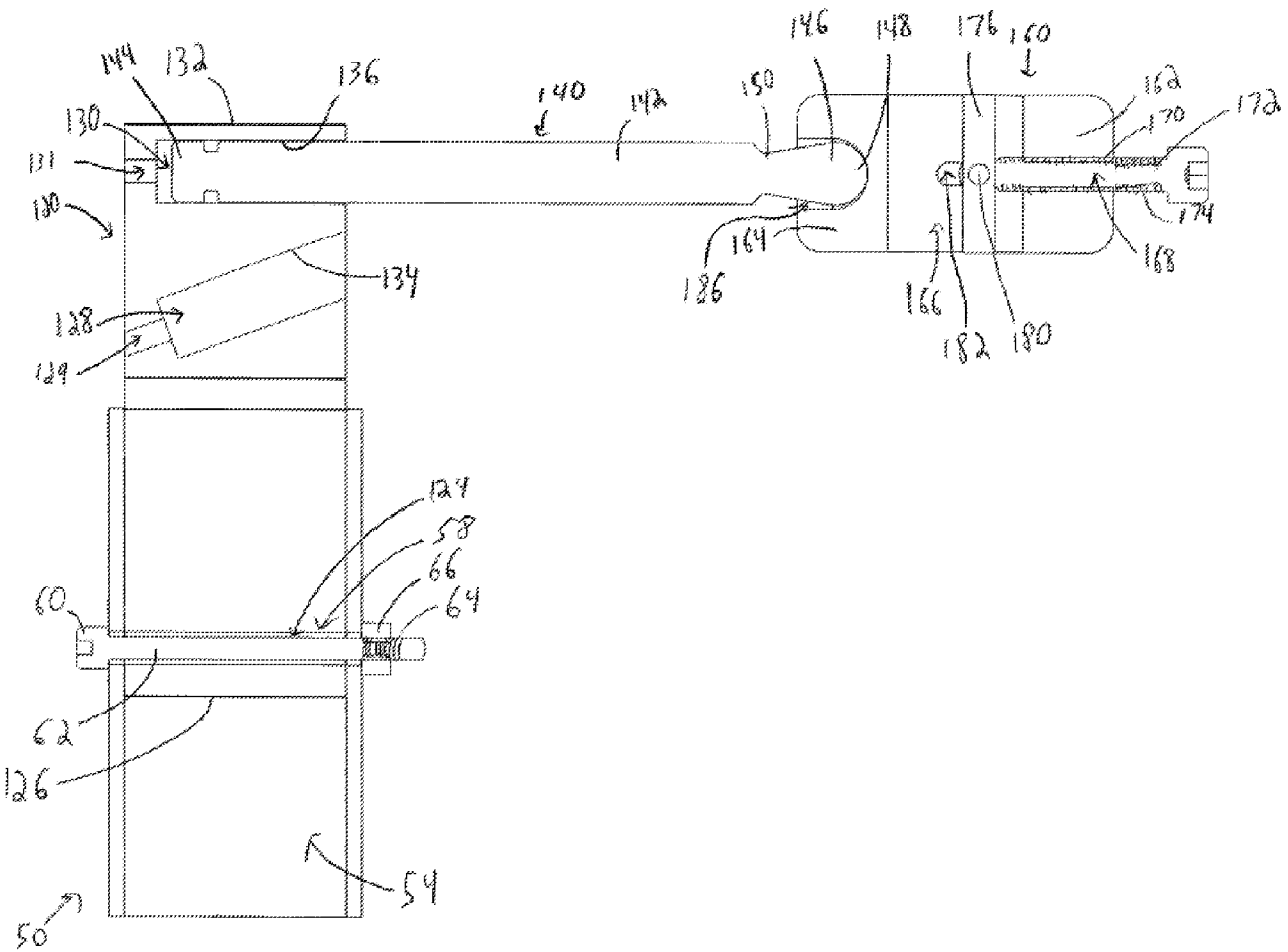
FIGS. 5A-5C are cross-sectional views of the mounting assembly of FIG. 4 taken along section line 5-5, with FIG. 5A showing the elongate member inserted into a first opening of the bracket, FIG. 5B showing the elongate member inserted into a second opening of the bracket, and FIG. 5C showing knock-out holes including threaded portions.
Figure 5B:
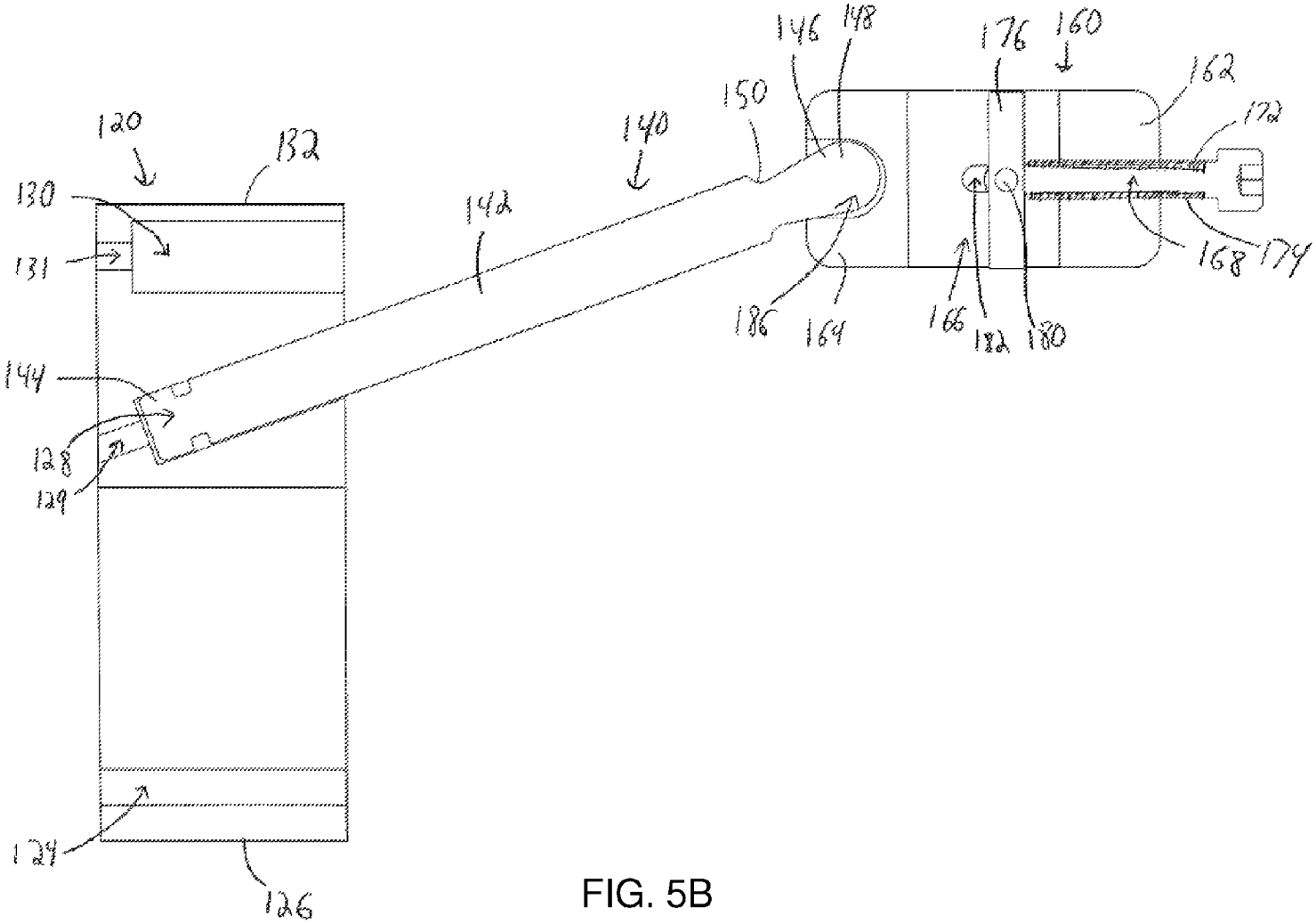
Figure 5C:
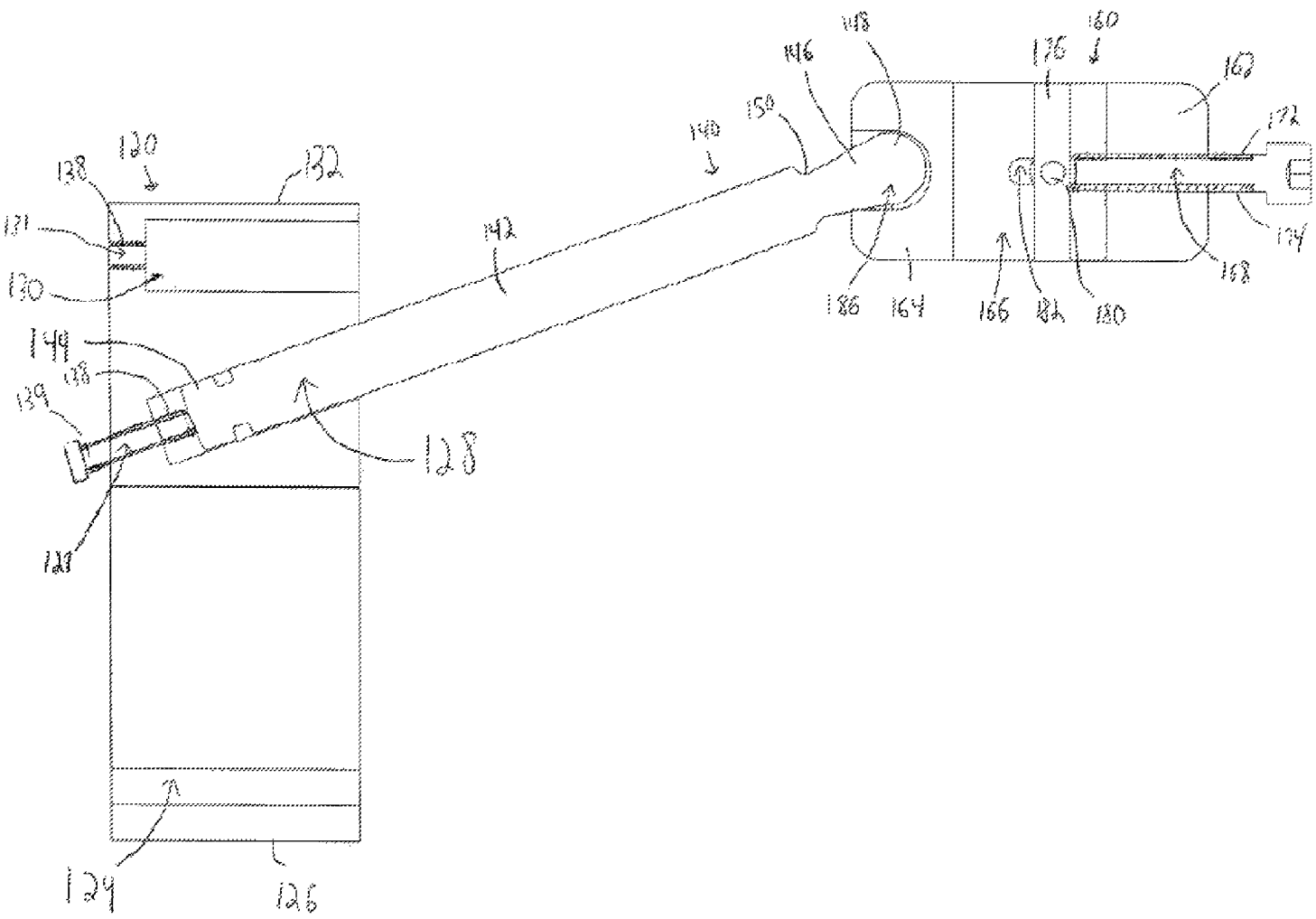
Figure 6:
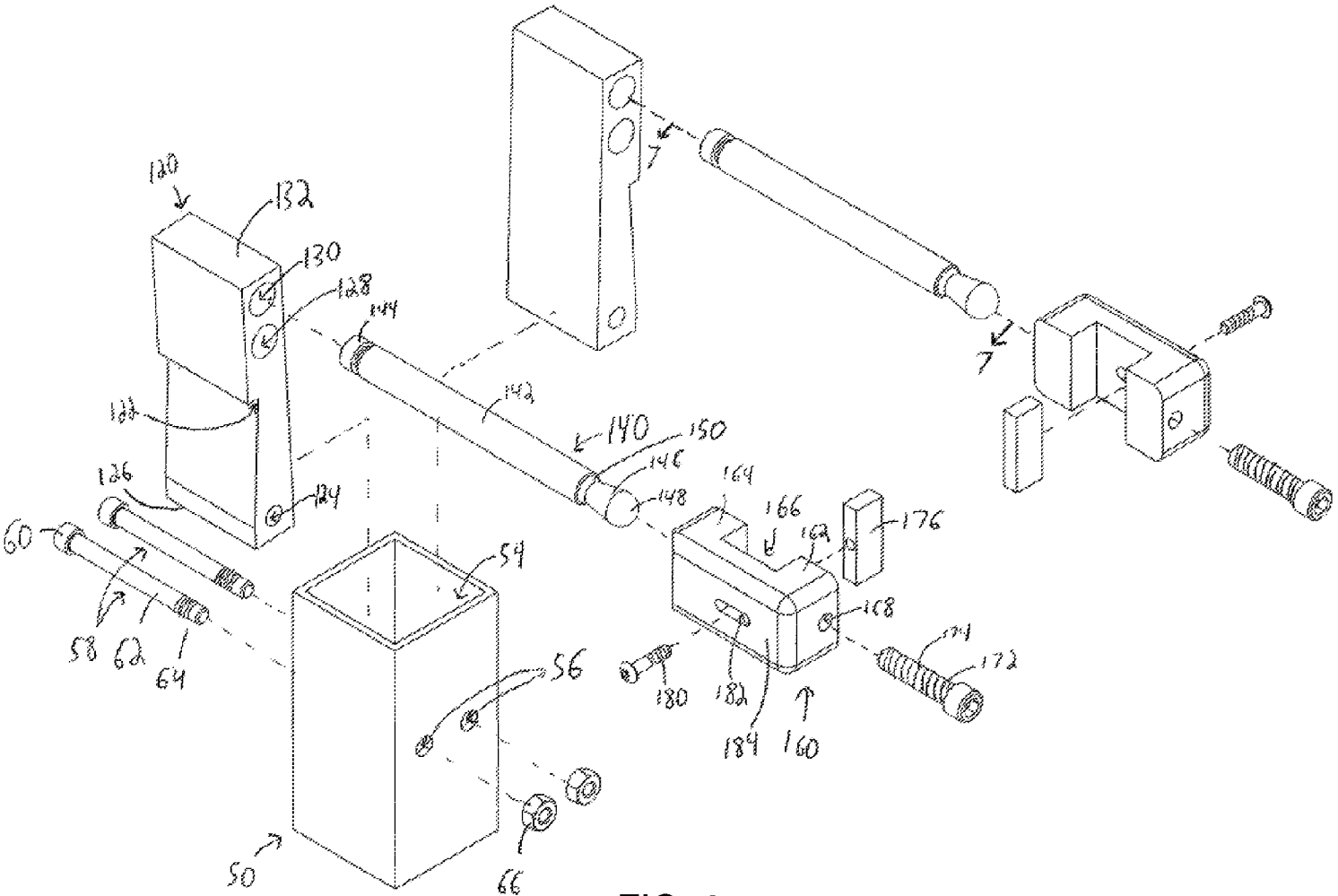
FIG. 6 is an exploded perspective view of the mounting assembly of FIG. 4.

With reference to FIGS. 4-6, mounting assembly 100 will now be described. Mounting assembly 100 includes a pair of brackets 120, a pair of rods 140 and a pair of grippers 160. Alternatively each mounting assembly 100 may include only a single bracket 120, rod 140 and gripper 160. Each bracket 120 includes an inward depending section 122, a screw hole 124 extending therethrough and disposed proximate a first end 126 of bracket 120 for the reception of screws 58 therethrough, a rod receiving opening 130 disposed proximate a second end 132 and a rod receiving opening 128 disposed between screw hole 124 and rod receiving opening 130. A larger or smaller number of rod receiving openings may be provided as desired. Rod receiving openings 128 and 130 include smooth inner surfaces 134 and 136 respectively configured for the removable reception of rods 140 therein. As seen in FIGS. 5A and 5B, rod receiving opening 130 may be aligned parallel to screw hole 124 while rod receiving opening 128 may define an angle of twenty degrees relative to rod receiving opening 130 and screw hole 124. Alternatively rod receiving opening 128 may define other angles as necessary or rod receiving opening 130 may also define an angle relative to screw hole 124 as desired. Rod receiving openings 128 and 130 may be cylindrical, triangular, square shaped, star shaped, or any other shape suitable to receive a rod 140 or any other member for use with an archery bow press. Mounting assembly 100 may alternatively include a single bracket (not shown) instead of a pair of brackets 120 where the single bracket includes two rod receiving openings 128 and two rod receiving openings 130. Brackets 120 may also alternatively include more or less rod receiving openings 128 and 130 having various angles depending on the bow to be maintained.

Each rod receiving opening 128 and 130 may also include a knock-out hole 129 and 131 respectively where each of knock-out holes 129 and 131 extends from a respective rod receiving opening 128 and 130 through bracket 120 and has a diameter which is smaller than that of its respective rod receiving opening 128 and 130. Knock-out holes 129 and 131 prevent air from being trapped between rod 140 and rod receiving openings 128 or 130 to prevent a suction effect from preventing removal of rod 140. Knock-out holes 129 and 131 may also be used to provide access to rod 140 to assist in removing rod 140 from rod receiving openings 128 and 130. For example an elongate member (not shown) may be inserted into one of knock-out holes 129 or 131 to apply force to rod 140 inserted into a respective rod receiving opening 128 and 131 to push rod 140 out of the respective rod receiving opening 128 or 131.

Referring to FIG. 5C, knock-out holes 129 and 131 may alternatively include an interior threaded portion 138 for the reception of a positioning screw 139. Positioning screw 139 provides a user with fine adjustment of the position of rod 140 within rod receiving openings 128 and 130 by engaging threaded portion 138 and entering a respective rod receiving opening 128 or 130 to limit the depth to which rod 140 can be inserted into rod receiving opening 128 or 130.

Screw hole 124 defines a generally smooth bore such that screw 58 may slide through screw hole 124 without impeding the rotational movement of bracket 120 about screw 58. Alternatively, screw 58 may secure bracket 120 rigidly in place. Inward depending section 122 in conjunction with screw hole 124 and passage 54 provide bracket 120 with a limited range of rotational motion relative to opening 54 about screw hole 124. Each pair of brackets 120 is a mirror of the other such that inwardly depending sections 122 are on opposite sides of opening 54 when inserted. Passage 54 may also include a divider (not shown) extending down its center for separating brackets 120 apart.

Figure 7:
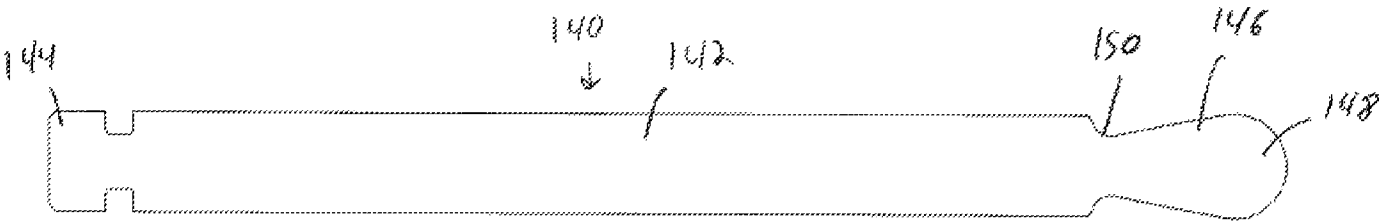
FIG. 7 is a cross-sectional view of the elongate member of the mounting assembly of FIG. 4 taken along section line 7-7 of FIG. 6.

Referring now to FIG. 7, each rod 140 includes an elongate section 142, a bracket end 144 extending from elongate section 142 and adapted for removable reception within rod receiving openings 128 or 130 of bracket 120 and a tip 146 adapted for reception within one of grippers 160. Tip 146 includes a rounded end 148 and a tapered section 150 tapering radially inward from rounded end 148 toward elongate section 142 such that the diameter of tapered section 150 becomes less than that of elongate section 142. This allows rod 140 to engage gripper 160 while still allowing gripper 160 to move or rotate about rod 140 as the force is applied from rod 140 to gripper 160 to compress bow 400 as will be described in more detail below. Rod 140 may be cylindrical, triangular, square shaped, star shaped, or any other shape suitable for insertion into rod receiving openings 128 and 130 and different portions of rod 140 may be different shapes as needed. For example, elongate section 142 may be square shaped while tip 148 still maintains a rounded end 148 and tapered section 150.

Figure 8:
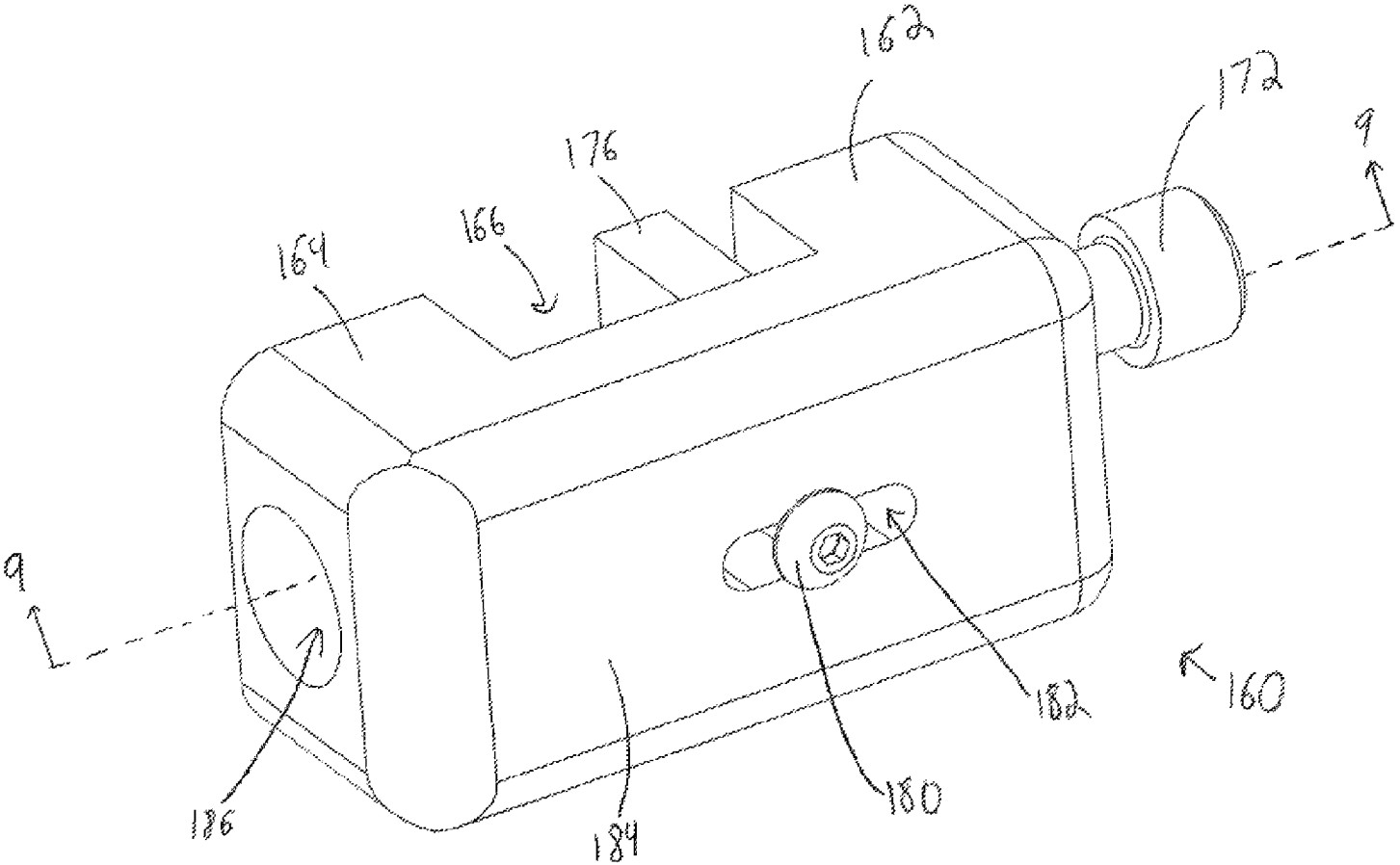
FIG. 8 is a perspective view of one of the grippers of the mounting assembly of FIG. 4.
Figure 9:
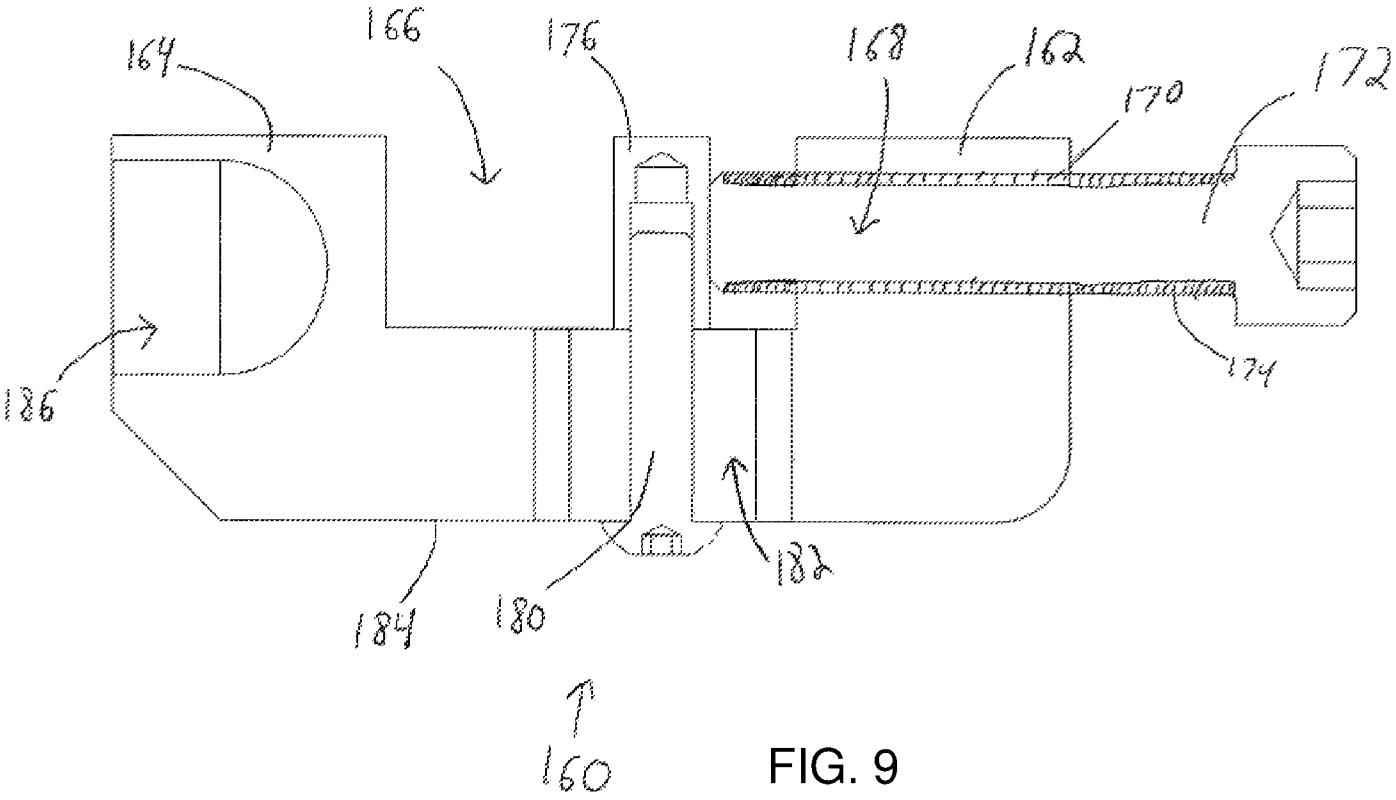
FIG. 9 is a cross-sectional view of the gripper of FIG. 8 taken along section line 9-9.

Referring now to FIGS. 8-9, each gripper 160 defines a generally "C" shaped cross-section having a first end 162 and a second end 164 on the respective sides of the "C" shape with a gripping space 166 defined therebetween. Gripper 160 includes a screw hole 168 having an internal thread 170 extending through first end 162 for the reception of a pad screw 172. Pad screw 172 defines an external thread 174 for engagement with internal thread 170 and is adapted apply pressure to a pad 176 disposed between first end 162 and one of upper and lower limbs 420 and 430 of bow 400 positioned within gripping space 166 between first end 162 and second end 164 to thereby secure gripper 160 to bow 400. Pad 176 is secured within gripping space 166 by a sliding screw 180 extending through a sliding slot 182 extending through an outer wall 184 of gripping space 166. Sliding slot 182 allows sliding screw 180 and thus pad 176 to move axially between first and second ends 162 and 164. A second pad (not shown) may also be provided between the one of upper and lower limbs 420 and 430 and second end 164 such that as pad screw 172 is threaded into screw hole 168 to engage pad 176 against upper or lower limb 420 or 430, the limb 420 or 430 also engages second pad (not shown) against second end 164 to thereby secure limb 420 or 430 of bow 400 between pad 176 and the second pad (not shown) while preventing damage bow 400. The second pad (not shown) may be removably attached to second end 164 by a screw or other attachment means or may alternatively be permanently bonded or affixed to second end 164 as known in the art. Second pad (not shown) may also be movable between first and second ends 162 and 164 in a manner similar to that described above for pad 176. Pad 176 and the second pad (not shown) may be made of a soft material which prevents damage to bow 400 while still being capable of securing gripper 160 to bow 400 when pressed against upper or lower limbs 420 or 430 by pad screw 172. Pad 176 and second pad (not shown) may be made of materials such as, for example, foams, rubbers, fiberglass, composites, ceramics, plastics or any material which is adapted to press against and secure limb 420 or 430 to gripper 160. Although gripper 160 is discussed for use with a pad screw 172 and a pad 176, it is contemplated that gripper 160 may be any other type of mechanism suited for securing a bow limb such as, for example, a clamp, a clasp, a clip, a friction fit, a friction pad, etc. Gripper 160 is not limited to a "C" shape but may be any other shape suitable to the purpose of receiving and securing a bow limb. It is further contemplated that gripper 160 may grip a bow limb without the use of the screws or pads described above and may include the use of an adhesive.

Each gripper 160 also includes a rod hole 186 extending partially through second end 164 and adapted for the reception of tip 146 of rod 140. Rod hole 186 is dimensioned to allow gripper 160 to move relative to tip 146 of rod 140 during use while still retaining tip 146 of rod 140 within rod hole 186 when under load. This allows gripper 160 and rod 140 to be used with bows of varying size since gripper 160 is able to adjust its position relative to rod 140 as more load is applied without breaking free of rod 140.

Figure 10:
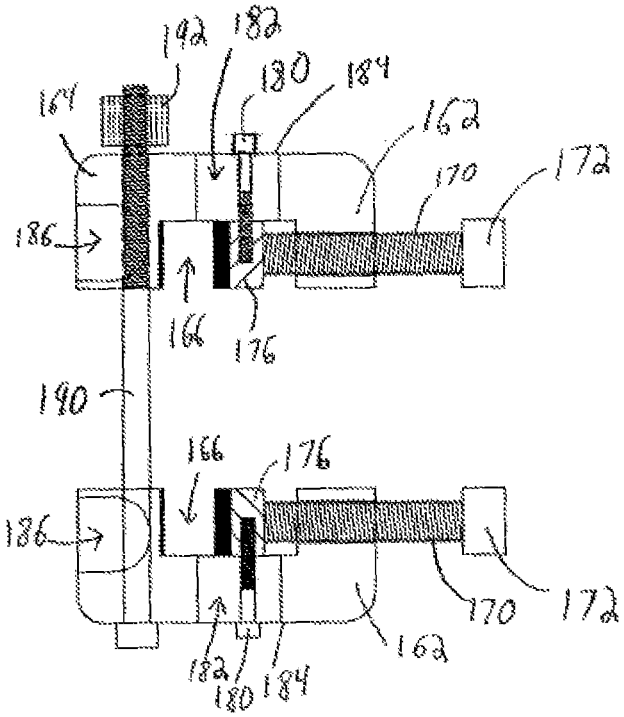
FIG. 10 is a side cross-section view of a pair of grippers with a safety screw hole and a safety screw inserted therethrough in accordance with another embodiment of the present disclosure.
Figure 11:
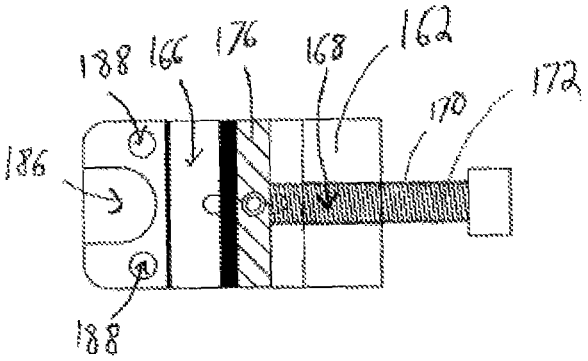
FIG. 11 is a back cross-section view of the grippers of FIG. 10.

Referring now to FIGS. 10 and 11, second end 164 may also include one or more safety holes 188 therethrough for the reception of one or more safety screws 190. Each safety screw 190 is of sufficient length to extend through a safety hole 188 of each of a respective pair of grippers 160 to further secure the pair of grippers 160 together after grippers 160 have been mounted to bow 400. Safety screw 190 is secured in place by engagement with a safety nut 192. This additional safeguard further secures bow 400 to mounting assembly 100.

During use, referring now to FIGS. 12-14, frame 20 is initially bolted down or otherwise secured to a base or workbench. Next the operator attaches or mounts two grippers 160 to each of upper and lower limbs 420 and 430. Grippers 160 are positioned on upper and lower limbs 420 and 430 generally adjacent to or near upper and lower ends 422 and 432. In the case of a compound bow 400, grippers 160 are positioned adjacent wheels/cams 442 where grippers 160 are between wheels/cams 442 and handle/riser 410. Grippers 160 may alternatively be positioned at upper and lower ends 422 and 432 as desired.

When attaching or mounting a first of grippers 160, the operator positions the first of grippers 160 such that upper limb 420 is disposed at least partially within gripping space 166 between first end 162 and second end 164. Pad screw 172 is then advanced through screw hole 168 to press pad 176 against upper limb 420 to thereby secure the first of grippers 160 to upper limb 420. Once the first of grippers 160 is secured to upper limb 420, the operator repeats the process for a second of grippers 160 which is then attached or mounted opposite the first of grippers 160. The operator then likewise secures a third and fourth of grippers 160 to lower limb 430. Each pair of grippers 160 is positioned on opposite sides of upper or lower limbs 420 and 430 respectively where for example, gripping space 166 of the first of grippers 160 is oriented toward gripping space 166 of the second of grippers 160. Each of the upper and lower limbs 420 and 430 may alternatively receive only a single gripper.

Once all four grippers 160 are secured to bow 400, brackets 120 are inserted into passages 54 of arm members 50 and 52. Each arm member 50 and 52 receives a pair of brackets 120 oriented with inward depending sections 122 on opposite sides of passage 54, facing outward, and rod receiving openings 128 and 130 facing toward the other of arm members 50 and 52, as seen in FIG. 4. Once brackets 120 are positioned within passage 54, screws 58 are inserted through respective holes 56 and screw holes 124 to secure brackets 120 in position within passage 54. Nuts 66 are then threaded onto threaded ends 64 of screws 58 to secure screws 58 in place. In this way brackets 120 are secured within passage 54 while still being rotatable relative to screws 58. Brackets 120 may alternatively be inserted into passages 54 prior to or concurrently with the attachment or mounting of grippers 160 to bow 400.

Next the operator determines which of rod receiving openings 128 and 130 is best suited for the particular bow 400 being serviced and inserts bracket end 144 of one of rods 140 into each respective rod receiving opening 128 or 130 of each of the four brackets 120. Bow press 10 is now ready to receive bow 400. The operator actuates actuating member 36 to extend inner shaft 34 relative to outer shaft 32, thereby increasing the distance between arm members 50 and 52. Once arm members 50 and 52 are a sufficient distance apart the operator positions bow 400 between arm members 50 and 52 such that tips 146 of rods 140 are adjacent rod holes 178 of grippers 160. The operator then positions bow 400 such that rod holes 178 of the pair of grippers 160 mounted or attached to upper limb 420 receive tips 146 of the pair of rods 140 extending from brackets 120 of arm member 52. In this way one side of bow 400 is now supported by a pair of rods 140. The operator then actuates actuating member 36 to reduce the distance between arm members 50 and 52 until tips 146 of the other pair of rods 140 slot into rod holes 178 of the other pair of grippers 160 attached or mounted to lower limb 430. The operator may alternatively position bow 400 such that rod holes 178 of grippers 160 attached or mounted to lower limb 430 receive tips 146 of rods 140 first. In this way the operator can easily mount bow 400 on bow press 10 prior to applying compression force to bow 400.

Once bow 400 is seated on bow press 10 the operator actuates actuating member 36 to further reduce the distance between arm members 50 and 52. Reducing the distance between arm members 50 and 52 forces respective brackets 120 and rods 140 closer together thereby applying force in an inward direction "X" to grippers 160 and upper and lower limbs 420 and 430 of bow 400 toward the center of the curvature of bow 400. In this way bow 400 is compressed to reduce the tension on string/cable 450 (FIG. 14) to thereby allow the operator to perform maintenance on bow 400.

During the application of force between brackets 120, rods 140 and grippers 160, brackets may rotate about screw 58 to displace in a generally radially outward direction from a longitudinal axis of passage 54. In addition, grippers 160 are adapted to move and adjust about tips 146 as larger forces are applied where, for example, the force being applied from bracket 120 to gripper 160 along rod 140 is not always aligned with rod receiving openings 128 and 130 or rod hole 178. In addition rod receiving openings 128 and 130 may be aligned differently than rod hole 180 with respect to a longitudinal axis of rod 140. This is possible due to the shape of tip 146 where even when tip 146 presses against a side of rod hole 178, compressive force is still applied to gripper 160 and bow 400 is still prevented from breaking free. In addition any shearing force is balanced out by force applied to the other of the pair of grippers 160 for the upper or lower limb 420 and 430 which is also applied in a direction which is not parallel to the longitudinal axis of the respective rod 140.

Although the present disclosure has been described with respect to preferred embodiments, it will be readily apparent, to those having ordinary skill in the art that changes and modifications may be made thereto without departing from the spirit or scope of the subject apparatus.

The invention claimed is:

1. Components for an archery bow press, the components comprising:

at least two arm members configured to extend from a shaft of a frame, the frame actuatable to move the at least two arm members relative to one another, the shaft defining a longitudinal axis, the at least two arm members each defining at least one sidewall, the sidewall defining a lower portion and an upper portion, the at least two arm members each including a first segment extending from the shaft and inclined at a first obtuse angle with respect to the shaft;

the at least two arm members each including a second segment extending from the first segment at a second obtuse angle, the second segment intersecting the at least one sidewall of the at least two arm members with respect to the sidewall and at an acute angle with respect to the lower portion of the sidewall such that the first segment and the second segment cause the at least two arm members to be suspended at a distance horizontal to and above the longitudinal axis of the shaft of the frame;

at least one elongate member having a first end portion adapted for insertion into an opening of one of the at least two arm members; and at least one gripper defining a longitudinal axis and including a slot aligned with the longitudinal axis, the slot configured for the reception of a second end portion of the at least one elongate member, the gripper adapted to at least partially surround an archery bow limb and removably attach to the archery bow limb.

2. The components for an archery bow press according to claim 1, wherein each arm member includes a passage extending at least partially therethrough for the reception of a bracket, the bracket including at least one opening, the opening of the arm member being one of the openings of the bracket.

3. The components for an archery bow press according to claim 2, wherein a first of the openings of the bracket defines a first longitudinal axis and a second of the openings defines a second longitudinal axis disposed at an oblique angle relative to the first longitudinal axis, the elongate member being insertable into one of the first and second openings.

4. The components for an archery bow press according to claim 2, wherein the passage of each arm member is configured to receive two brackets therein.

5. The components for an archery bow press according to claim 2, wherein each bracket include a screw hole extending therethrough for the reception of a mounting screw, the screw hole defining a smooth inner bore to allow the bracket to rotate about the screw hole when the mounting screw is inserted therethrough.

6. The components for an archery bow press according to claim 5, wherein each bracket includes an inwardly depending section adapted to allow the bracket to at least partially rotate about the screw hole when inserted into the passage of one of the arm members.

7. The components for an archery bow press according to claim 1, wherein the arm members are configured to space an archery bow away from the frame.

8. The components for an archery bow press according to claim 7, wherein the arm members are oriented at a forty-five degree angle relative to a longitudinal axis of a leg of the frame.

9. The components for an archery bow press according to claim 1, wherein the shaft of the frame includes an inner shaft and an outer shaft, wherein the inner shaft is movable relative to the outer shaft upon actuation of an actuating mechanism, each arm member configured to extend from one of the inner and outer shafts.

10. The components for an archery bow press according to claim 1, wherein the elongate member defines a rounded tip at the second end portion and a tapered portion extending from the rounded tip toward the first end portion, the rounded tip adapted to allow the gripper assembly to rotate about the second end portion of the elongate member when the elongate member is inserted into the gripper assembly.

11. At least one component for an archery bow press, the at least one component comprising:

at least two arm members configured to extend from a shaft of a frame, the frame actuatable to move the at least two arm members relative to one another, the shaft defining a longitudinal axis, the at least two arm members each defining at least one sidewall, the sidewall defining a lower portion and an upper portion, the at least two arm members each including a first segment extending from the shaft and inclined at a first obtuse angle with respect to the shaft;

the at least two arm members each including a second segment extending from the first segment at a second obtuse angle, the second segment intersecting the at least one sidewall of the at least two arm members with respect to the sidewall and at an acute angle with respect to the lower portion of the sidewall such that the first segment and the second segment cause the at least two arm members to be suspended at a distance horizontal to and above the longitudinal axis of the shaft of the frame; and a gripper including:

a first portion including a pad coupled thereto; and a second portion configured to engage a first side of an archery bow limb, the second portion and the pad defining a space therebetween for the at least partial reception of an archery bow limb, the pad configured to engage a second side of the archery bow limb to secure the archery bow limb against the second portion.

12. The at least one component for an archery bow press according to claim 11, wherein the pad is moveable between the first and second portions of the gripper.

13. The at least one component for an archery bow press according to claim 12, wherein the pad is movable by a pad screw inserted through an opening extending through the first portion of the gripper.

14. The at least one component for an archery bow press according to claim 11, wherein a second pad is fixedly attached to the second portion of the gripper.

15. The at least one component for an archery bow press according to claim 11, wherein the second portion of the gripper includes at least one safety screw hole therethrough for the reception of a safety screw.

16. The at least one component for an archery bow press according to claim 11, wherein the second portion of the gripper includes an opening therein for the reception of a member of the archery bow press.

17. At least one component for an archery bow press, the at least one component comprising:

at least two arm members configured to extend from a shaft of a frame, the frame actuatable to move the at least two arm members relative to one another, the shaft defining a longitudinal axis, the at least two arm members each defining at least one sidewall, the sidewall defining a lower portion and an upper portion, the at least two arm members each including a first segment extending from the shaft and inclined at a first obtuse angle with respect to the shaft;

the at least two arm members each including a second segment extending from the first segment at a second obtuse angle, the second segment intersecting the at least one sidewall of the at least two arm members with respect to the sidewall and at an acute angle with respect to the lower portion of the sidewall such that the first segment and the second segment cause the at least two arm members to be suspended at a distance horizontal to and above the longitudinal axis of the shaft of the frame; and an elongate member including a first end and a second end, wherein the elongate member is configured to interface with a bracket including at least one opening extending at least partially therethrough, the bracket adapted for insertion into a passage of the archery bow press;

the first end of the elongate member insertable into one of the at least one openings of the bracket;

the elongate member configured to be received by a gripper assembly defining a longitudinal axis and including a slot aligned with the longitudinal axis, wherein the slot is configured to receive the second end of the elongate member to mount the gripper assembly onto the elongate member.

18. The at least one component for an archery bow press according to claim 17, wherein a first of the at least one opening of the bracket defines a first longitudinal axis and a second of the at least one opening of the bracket defines a second longitudinal axis disposed at an oblique angle relative to the first longitudinal axis, the elongate member being insertable into one of the first and the second of the at least one opening of the bracket.

19. The at least one component for an archery bow press according to claim 17, wherein the second end of the elongate member includes a rounded tip adapted to allow the gripper assembly to rotate about the second end of the elongate member.

20. The at least one component for an archery bow press according to claim 17, wherein the gripper assembly includes at least one safety screw hole for the reception of a safety screw therethrough.

21. The at least one component for an archery bow press according to claim 20, wherein the safety screw is adapted to secure the gripper assembly to a second gripper assembly of a second mounting assembly upon insertion through the safety screw hole and a respective safety screw hole of the second gripper assembly.

22. The at least one component for an archery bow press according to claim 17, wherein the at least one component further comprises: a bracket including at least one opening extending at least partially therethrough, the bracket adapted for insertion into a passage of the archery bow press; and a gripper assembly defining a longitudinal axis and including a slot aligned with the longitudinal axis, the slot configured to receive the second end of the elongate member to mount the gripper assembly onto the elongate member.

23. The at least one component for an archery bow press according to claim 22, wherein a first of the at least one opening of the bracket defines a first longitudinal axis and a second of the at least one opening of the bracket defines a second longitudinal axis disposed at an oblique angle relative to the first longitudinal axis, the elongate member being insertable into one of the first and the second of the at least one opening of the bracket.

24. The at least one component for an archery bow press according to claim 22, wherein the gripper assembly includes at least one safety screw hole for the reception of a safety screw therethrough, and wherein the safety screw is adapted to secure the gripper assembly to a second gripper assembly of a second mounting assembly upon insertion through the safety screw hole and a respective safety screw hole of the second gripper assembly.

* * * * *